US008050599B2

(12) United States Patent
Tanaka

(10) Patent No.: US 8,050,599 B2
(45) Date of Patent: Nov. 1, 2011

(54) TONER CARTRIDGE AND IMAGE FORMING APPARATUS HAVING TONER CARTRIDGE

(75) Inventor: Yoshiaki Tanaka, Numazu (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 103 days.

(21) Appl. No.: 12/197,700

(22) Filed: Aug. 25, 2008

(65) Prior Publication Data

US 2009/0060588 A1 Mar. 5, 2009

Related U.S. Application Data

(60) Provisional application No. 60/969,913, filed on Sep. 4, 2007.

(51) Int. Cl.
*G03G 15/08* (2006.01)

(52) U.S. Cl. ..... 399/263

(58) Field of Classification Search ..... 399/263
See application file for complete search history.

(56) References Cited

U.S. PATENT DOCUMENTS

2006/0013621 A1* 1/2006 Kimura et al. ..... 399/262
2007/0147899 A1* 6/2007 Kimura et al. ..... 399/254
2007/0269225 A1* 11/2007 Sato ..... 399/12

FOREIGN PATENT DOCUMENTS

JP 2001255728 A * 9/2001
JP 2005-070395 3/2005
JP 2007-310146 11/2007

OTHER PUBLICATIONS

Japanese Office Action dated Oct. 23, 2009, Japanese Application No. 10-2008-86633 with English translation.

* cited by examiner

*Primary Examiner* — Constantine Hannaher
(74) *Attorney, Agent, or Firm* — Patterson & Sheridan, LLP

(57) ABSTRACT

A toner cartridge includes a toner receptacle that houses toner, a plurality of stirring members housed in the toner receptacle, a plurality of gears meshing with each other on outside of the toner receptacle, and a phase display section. The stirring members are arranged next to each other in the toner receptacle and rotate to stir the toner. Each of the stirring members has a scraper that scrapes off the toner adhering to an inner surface of the toner receptacle. The gears rotate to rotate the stirring members in an interlocked manner with each other. The phase display section shows a meshing position of the gears so that the gears mesh with each other at a position where a phase difference along a rotating direction of the stirring members occurs between the scrapers of the stirring members that are next to each other.

12 Claims, 9 Drawing Sheets

TONER CARTRIDGE AND IMAGE FORMING APPARATUS HAVING TONER CARTRIDGE

CROSS-REFERENCE TO RELATED APPLICATIONS

This application claims the benefit of U.S. Provisional Applications No. 60/969,913 filed Sep. 4, 2007.

TECHNICAL FIELD

The present invention relates to a toner cartridge having a plurality of stirring members provided therein which stir toner by rotating synchronously with each other. The invention also relates to an image forming apparatus having a toner cartridge that supplies toner to a developing device.

BACKGROUND

An image forming apparatus, for example, a color copy machine or printer, has a toner cartridge to supply toner to a developing device. The toner cartridge is removably attached to the body of the image forming apparatus. A user can easily replace the toner cartridge when toner in the toner cartridge is used up.

For example, a toner cartridge disclosed in Japanese Patent Publication (KOKAI) No. 2007-310146 has an elongated cylindrical cartridge body that houses toner, a stirring member housed within the cartridge body, and a screw arranged at the bottom of the cartridge body. The cartridge body has a filling port from which toner is put into the cartridge body, and a discharge port from which the toner is discharged toward the developing device. The stirring member rotates in the cartridge body and thereby stirs the toner. The screw rotates in the cartridge body and thereby moves the toner toward the discharge port.

When the toner in the cartridge body is decreased, a gap is generated between the inner surface of the cartridge body and the stirring member. The toner thus unavoidably remains adhering to the inner surface of the cartridge body. To deal with this, in the toner cartridge disclosed in the above Patent Publication, a scraper is attached to the stirring member. The scraper is formed by a flexible sheet member made of synthetic resin and is protruding from the stirring member toward the inner surface of the cartridge body. The scraper moves in contact with the inner surface of the cartridge body when the stirring member rotates. Thus, the toner adhering to the inner surface of the cartridge body is scraped off by the scraper and is fed into the screw. Therefore, the toner in the toner cartridge can be effectively used without being wasted.

In the toner cartridge of this type, it is desirable that the quantity of toner filling is increased to reduce the frequency of replacing the toner cartridge. As an attempt to increase the quantity of toner filling, a pair of toner housing portions is formed within the toner cartridge body. The toner housing portions are arranged side by side in the cartridge body and a stirring member is arranged in each toner housing portion. Each stirring member has a driving gear. The gears mesh with each other on the outside of the cartridge body. This meshing causes the stirring members to rotate in the opposite directions synchronously with each other.

In this configuration, the arrangement spacing between the stirring members is defined so that the stirring members do not interfere with each other in the cartridge body. However, if scrapers are attached to the outer circumferences of the stirring members, when the stirring members rotates, the scrapers of the stirring members may contact each other. If the scrapers are damaged by their contact with each other, small pieces and particles generated by the damage are carried into the developing device together with toner. The small pieces and particles may cause malfunction of the developing device and obstruct formation of a high-quality image.

Therefore, when arranging a pair of stirring members with scrapers side by side, it is necessary to avoid mutual interference of the scrapers. To this end, gears must be meshed with each other at a position where a phase difference along the rotating direction of the stirring members occurs between the scrapers. In other words, when assembling the toner cartridge, the operator must define the meshing position of the gears that rotate with the stirring members, while confirming the position of the scrapers. This assembling operation of the toner cartridge requires a great amount of time and labor.

SUMMARY

It is an object of the invention to provide a toner cartridge in which mutual interference of scrapers of stirring members is prevented and the meshing position of gears can be easily defined, and that can be easily assembled.

It is another object of the invention to provide an image forming apparatus having a toner cartridge that can be easily assembled.

To achieve the above objects, a toner cartridge according to an aspect of the invention includes a toner receptacle that houses toner, a plurality of stirring members housed in the toner receptacle, a plurality of gears meshing with each other on outside of the toner receptacle, and a phase display section. The stirring members are arranged next to each other in the toner receptacle and rotate to stir the toner. Each of the stirring members has a scraper that scrapes off the toner adhering to an inner surface of the toner receptacle. The gears rotate to rotate the stirring members in an interlocked manner with each other. The phase display section shows a meshing position of the gears so that the gears mesh with each other at a position where a phase difference along a rotating direction of the stirring members occurs between the scrapers of the stirring members that are next to each other.

To achieve the above objects, an image forming apparatus according to another aspect of the invention includes an image forming unit having a developing device, and a toner cartridge that supplies toner to the developing device of the image forming apparatus. The toner cartridge includes a toner receptacle that houses toner, a pair of stirring members housed in the toner receptacle, and a pair of gears rotating together with the stirring members. The stirring members are arranged next to each other in the toner receptacle and rotate to stir the toner. Each of the stirring members has a scraper that scrapes off the toner adhering to an inner surface of the toner receptacle. The gears mesh with each other on outside of the toner receptacle and thereby rotate the stirring members synchronously with each other. The gears have a phase display section that shows a meshing position of the gears so that the gears mesh with each other at a position where a phase difference along a rotating direction of the stirring members occurs between the scrapers of the stirring members.

According to the invention, as the gears are meshed with each other with reference to the phase display section, a phase difference occurs between the scrapers of the stirring members. Therefore, mutual interference of the scrapers of the stirring members is prevented and the meshing position of the gears can be easily recognized. Thus, operability in assembling the toner cartridge is improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION

A first embodiment of the invention will be described with reference to FIG. 1 to FIG. 10.

Figure 1:
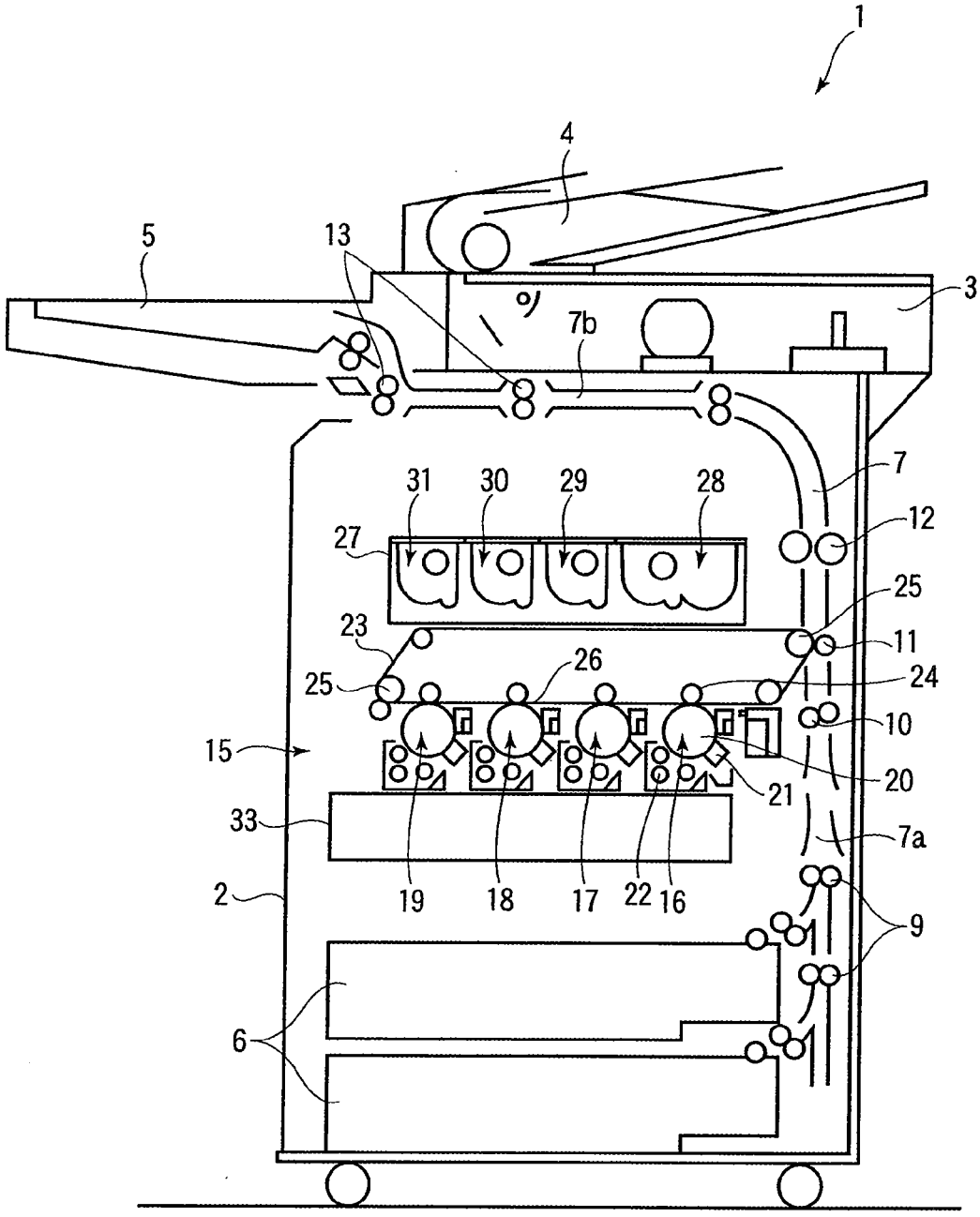
FIG. 1 is an exemplary side view schematically showing an image forming apparatus according to a first embodiment of the invention.

FIG. 1 schematically shows an image forming apparatus 1 such as a four-drum tandem color copy machine. The image forming apparatus 1 has an apparatus body 2. In an upper part of the apparatus body 2, a scanner 3 that optically scans image information such as characters from an original, an automatic document feeder 4 that automatically sends the original into the scanner 3, and a paper discharge tray 5 are provided.

In a lower part of the apparatus body 2, plural paper feeding cassettes 6 are provided. The paper feeding cassettes 6 are connected to the paper discharge tray 5 via a carrying path 7. The carrying path 7 is to guide sheets housed in the paper feeding cassettes 6, one by one to the paper discharge tray 5. The carrying path 7 has a first path 7*a* extending upward from the paper feeding cassettes 6, and a second path 7*b* extending horizontally from the upper edge of the first path 7*a* toward the paper discharge tray 5. Below the first path 7*a*, plural paper feeding rollers 9, a registration roller 10, a transfer roller 11 and a fixing unit 12 are provided in order. In the second path 7*b*, plural paper discharge rollers 13 are provided.

As shown in FIG. 1, an image forming section 15 is provided in a middle stage of the apparatus body 2. The image forming section 15 has a first image forming unit 16 for forming a black image, a second image forming unit 17 for forming a cyan image, a third image forming unit 18 for forming a magenta image, and a fourth image forming unit 19 for forming a yellow image. The first to fourth image forming units 16 to 19 are horizontally arrayed in a line along the direction of the width of the apparatus body 2.

Each of the first to fourth image forming units 16 to 19 has a photoconductive drum 20, a charger 21 that uniformly charges the outer circumferential surface of the photoconductive drum 20, a developing device 22 that develops, with toner, an electrostatic latent image formed on the outer circumferential surface of the photoconductive drum 20, and an intermediate transfer roller 24 that transfers the toner image on the photoconductive drum 20 to an intermediate transfer belt 23. The charger 21, the developing device 22 and the intermediate transfer roller 24 are arranged to surround the photoconductive drum 20.

The intermediate transfer belt 23 is endlessly laid over plural rollers 25 and is provided above the first to fourth image forming units 16 to 19. The intermediate transfer belt 23 has a horizontal traveling part 26 that horizontally travels along the arraying direction of the first to fourth image forming units 16 to 19. The horizontal traveling part 26 passes between the photoconductive drums 20 of the first to fourth image forming units 16 to 19 and the intermediate transfer roller 24. Moreover, the intermediate transfer belt 23 is pressed to the transfer roller 11 on the carrying path 7 via one roller 25.

As shown in FIG. 1, a cartridge housing portion 27 is provided above the intermediate transfer belt 23. First to fourth toner cartridges 28, 29, 30 and 31 are removably housed in the cartridge housing portion 27. The first toner cartridge 28 supplies black toner to the developing device 22 of the first image forming unit 16. The second toner cartridge 29 supplies cyan toner to the developing device 22 of the second image forming unit 17. The third toner cartridge 30 supplies magenta toner to the developing device 22 of the third image forming unit 18. The fourth toner cartridge 31 supplies yellow toner to the developing device 22 of the fourth image forming unit 19.

A laser unit 33 is provided below the first to fourth image forming units 16 to 19. The laser unit 33 casts light corresponding to image information to the photoconductive drums 20 of the first to fourth image forming units 16 to 19. Consequently, electrostatic latent images in the colors to be developed are formed on the outer circumferential surfaces of the photoconductive drums 20 of the first to fourth image forming units 16 to 19.

In the image forming apparatus 1 as described above, the electrostatic latent images formed on the outer circumferential surfaces of the photoconductive drums 20 of the first to fourth image forming units 16 to 19 are developed by toner of desired colors by the developing devices 22 and thus visualized as toner images. The toner images of the four colors formed by the first to fourth image forming units 16 to 19 are sequentially transferred to the intermediate transfer belt 23 via the intermediate transfer roller 24 and superimposed on this intermediate transfer belt 23.

When the superimposition of the toner images of the four colors on the intermediate transfer belt 23 is completed, a sheet supplied from one paper feeding cassette 6 to the first path 7*a* of the carrying path 7 is guided to the position of the intermediate transfer belt 23 via the registration roller 10. Thus, the toner images of the four colors superimposed on the intermediate transfer belt 23 are transferred to the sheet via the transfer roller 11. The full-color image transferred to the sheet is fixed to the sheet by the fixing unit 12. The sheet having the full-color image fixed thereto is guided to the paper discharge tray 5 through the second path 7*b* of the carrying path 7.

Next, the first to fourth toner cartridges 28 to 31 that supply toner to the first to fourth image forming units 16 to 19 will be described. The second to fourth toner cartridges 29 to 31 have a configuration similar to the toner cartridge disclosed in the Japanese Patent Publication (KOKAI) No. 2007-310146. Therefore, the second to fourth toner cartridges 29 to 31 will not be described further in detail.

The first toner cartridge 28, which houses black toner, consumes the toner more quickly than the second to fourth toner cartridges 29 to 31. Therefore, the first toner cartridge 28 employs a configuration to increase the quantity of toner filling in order to reduce the replacement frequency. Hereinafter, the first toner cartridge 28 will be described in detail.

As shown in FIG. 2 to FIG. 5, the first toner cartridge 28 has a cartridge body 35 that is made of synthetic resin. The cartridge body 35 is in the form of an elongated box having a long axis L1 along the direction of the depth of the image forming apparatus 1 and a short axis S1 along the direction of the width of the image forming apparatus 1. The cartridge body 35 is removably inserted into the cartridge housing portion 27 from the front side of the image forming apparatus 1.

The cartridge body 35 includes a container 36 and a top cover 37. The container 36 is in the form of an elongated box having left and right side walls 38*a* and 38*b*, a bottom wall 39, a rear wall 40, a front wall 41 and an opening 42. The side walls 38*a* and 38*b* extend along the long axis L1 of the cartridge body 35 and face each other in the direction of the short axis S1. The bottom wall 39 is laid between the lower edge of the side wall 38*a* and the lower edge of the side wall 38*b*. The rear wall 40 is situated at one end along the direction of the long axis L1 of the cartridge body 35. The front wall 41 is situated at the other end along the direction of the long axis L1 of the cartridge body 35. The opening 42 has a rectangular opening shape prescribed by the upper edges of the side walls 38*a* and 38*b*, the upper edge of the rear wall 40 and the upper edge of the front wall 41, and faces the bottom wall 39.

When the cartridge body 35 is inserted into the cartridge housing portion 27 of the image forming apparatus 1, the rear wall 40 of the cartridge body 35 faces a coupling, not shown, that is situated at the terminal end of the cartridge housing portion 27. The coupling is driven by a driving device provided in the apparatus body 2 of the image forming apparatus 1.

The top cover 37 seals the opening 42 of the container 36. The top cover 37, in cooperation with the container 36, forms a toner receptacle 43 for housing black toner on the inside of the cartridge body 35.

Figure 2:
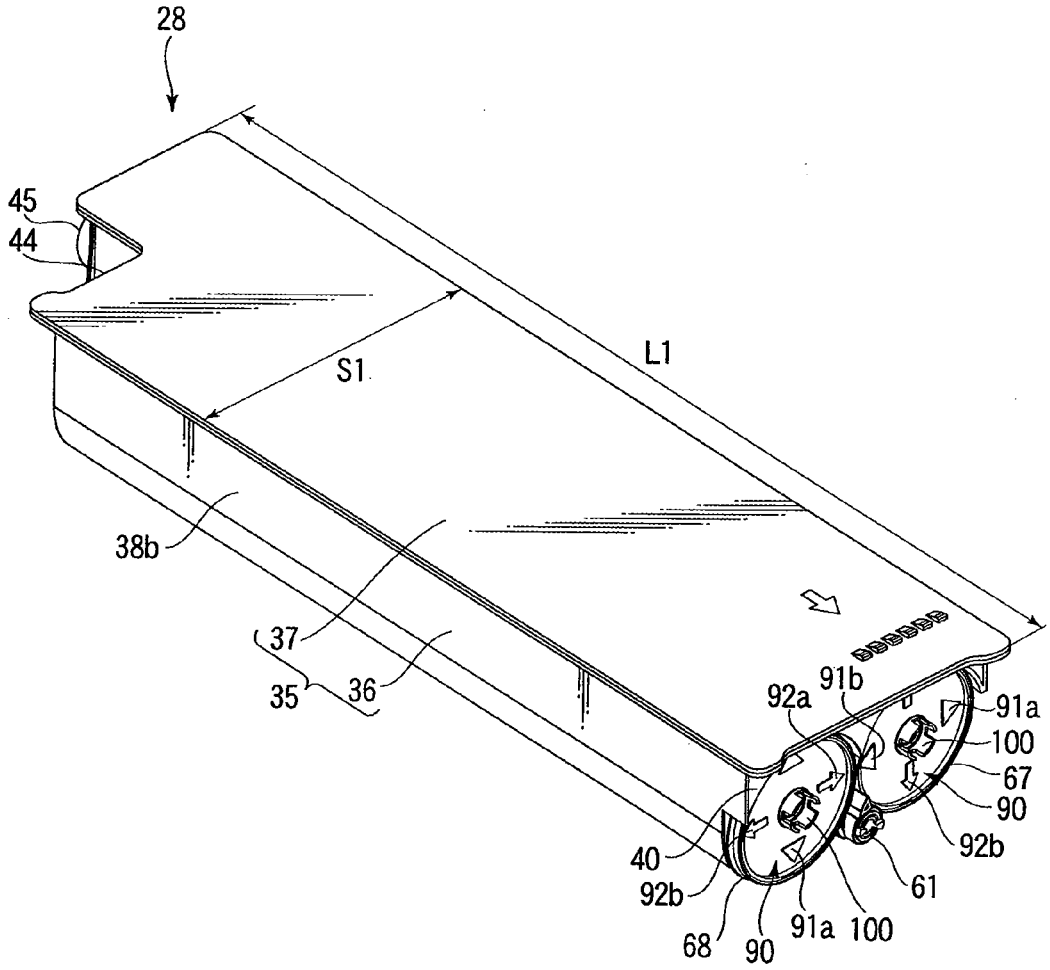
FIG. 2 is an exemplary perspective view of a toner cartridge according to the first embodiment of the invention.
Figure 3:
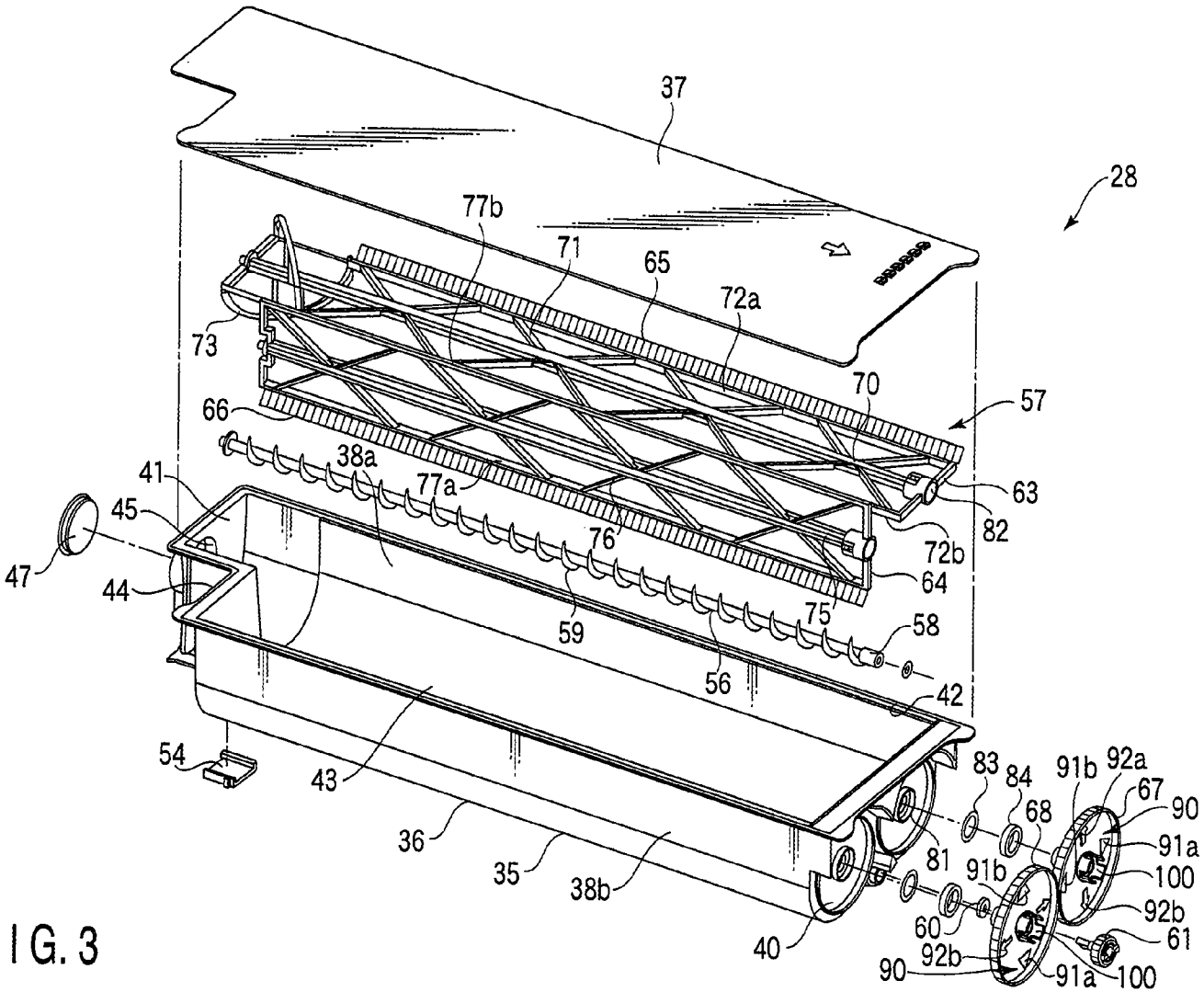
FIG. 3 is an exemplary exploded perspective view of the toner cartridge according to the first embodiment of the invention.
Figure 4:
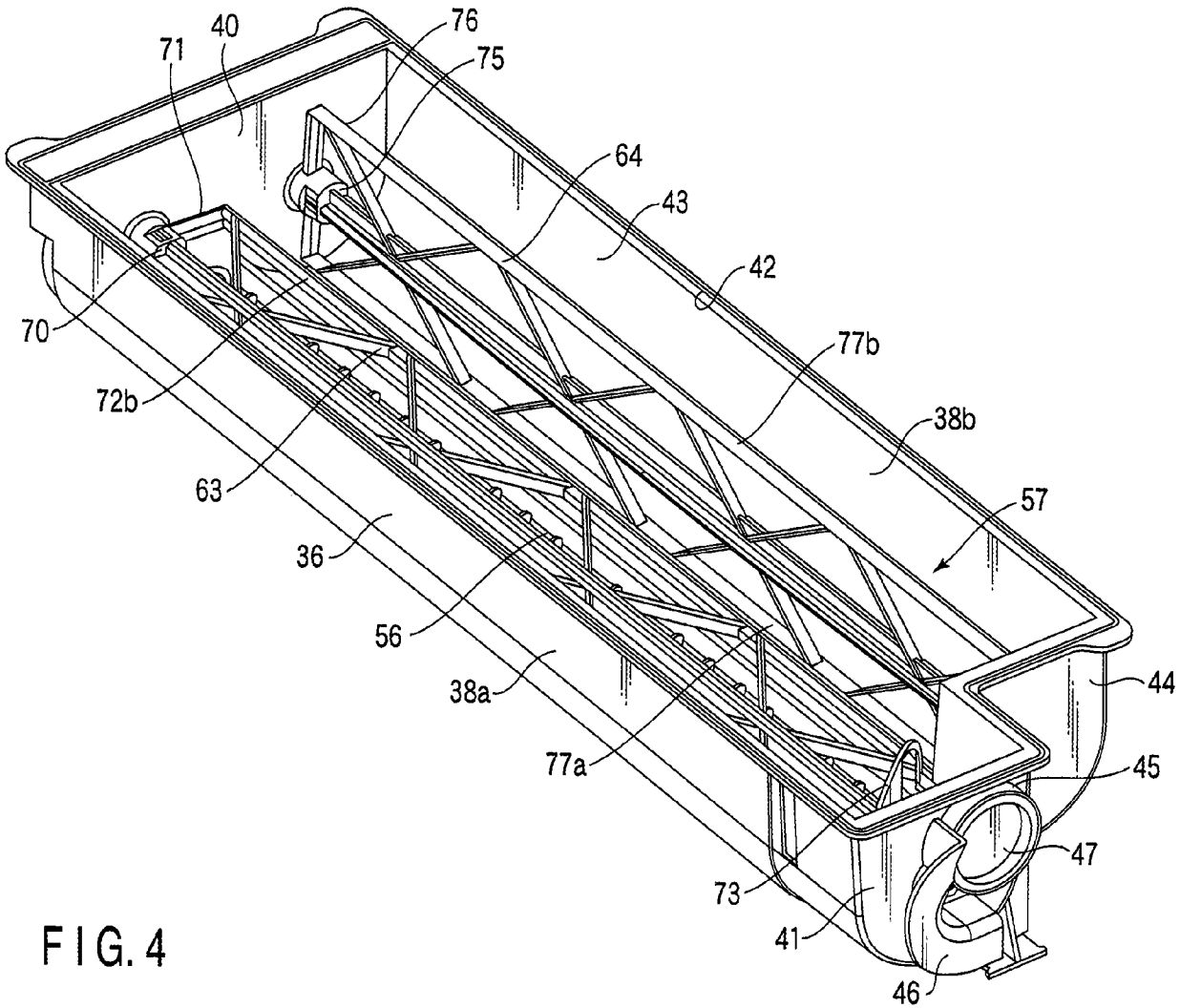
FIG. 4 is an exemplary perspective view of a container that houses a pair of stirring members and a screw in the first embodiment of the invention.

As shown in FIG. 2 to FIG. 4, a recess 44 is formed in the front wall 41 of the container 36. The recess 44 is recessed from the front wall 41 toward the rear wall 40. Therefore, the front end part of the cartridge body 35 is formed stepwise.

A filling port 45 and a handle 46 are formed in the front wall 41 of the container 36. The filling port 45 is for filling the toner receptacle 43 with black toner and is arranged next to the recess 44. The filling port 45 is sealed by a cap 47 after toner filling is completed. The handle 46 is for a user to hook a finger on when pulling the cartridge body 35 out of the cartridge housing portion 27. The handle 46 is situated on the periphery of the filling port 45 and protrudes from the front wall 41 into the direction of the long axis L1 of the cartridge body 35.

Figure 5:
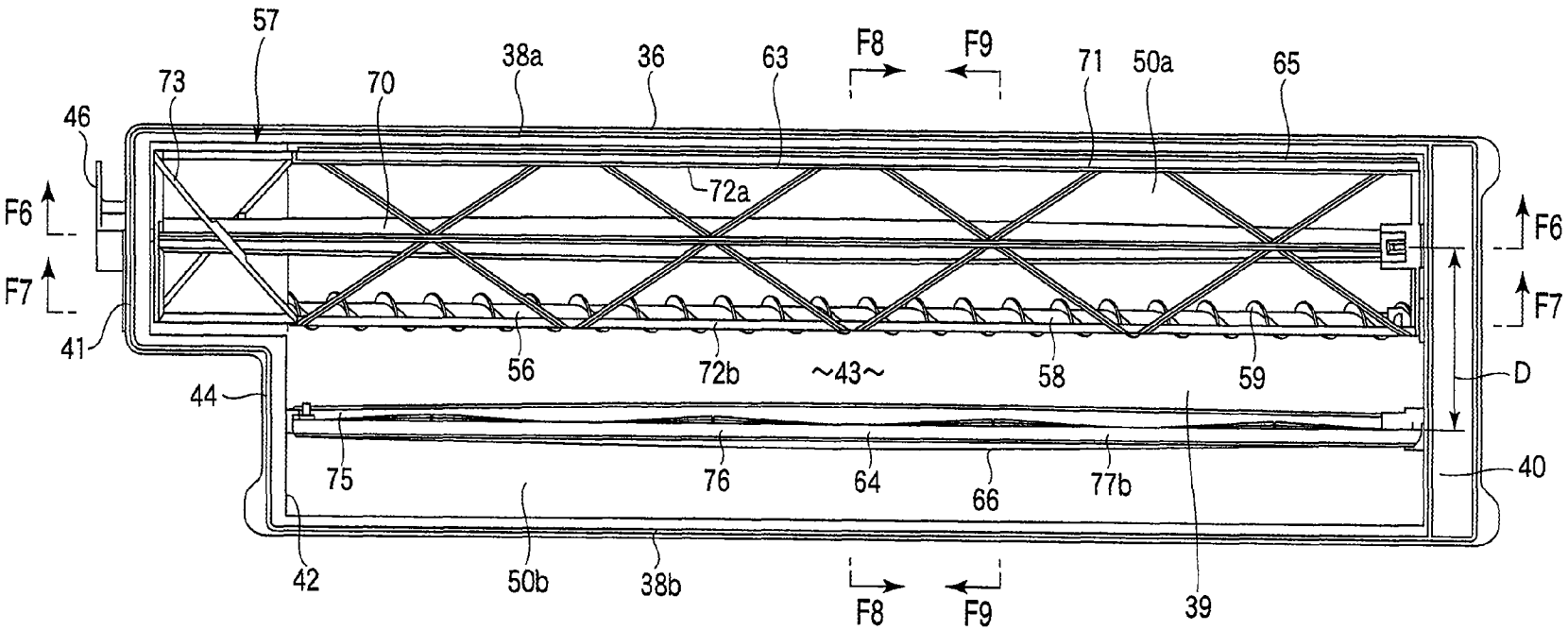
FIG. 5 is an exemplary plan view of the container that houses the stirring members and the screw in the first embodiment of the invention.
Figure 8:
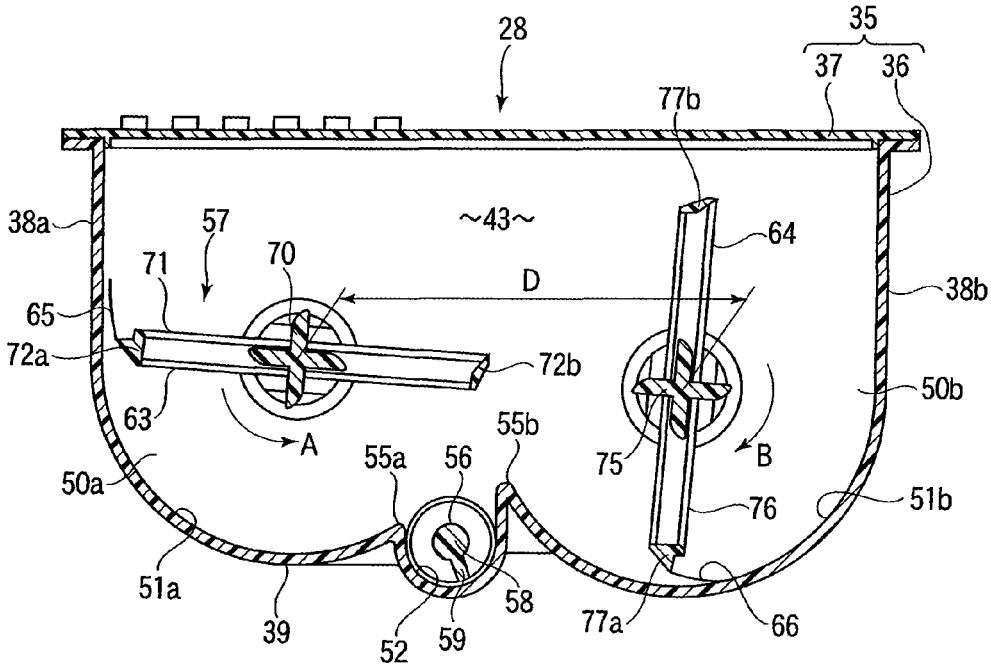
FIG. 8 is an exemplary sectional view taken along a line F8-F8 of FIG. 5.
Figure 9:
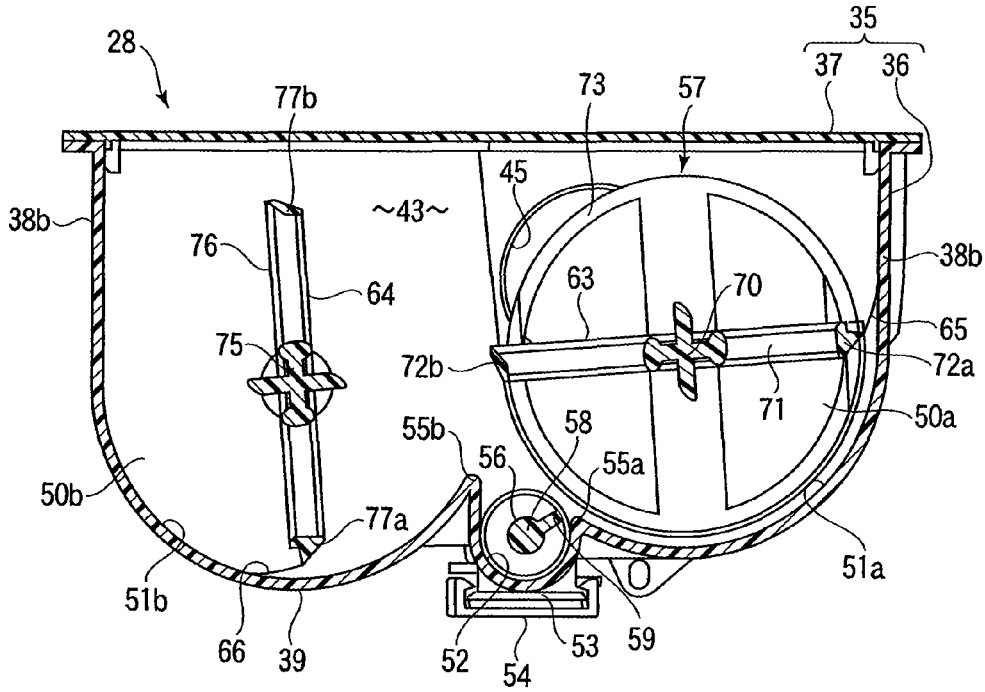
FIG. 9 is an exemplary sectional view taken along a line F9-F9 of FIG. 5.

As shown in FIG. 5, FIG. 8 and FIG. 9, the toner receptacle 43 has a pair of toner housing portions 50*a* and 50*b*. The toner housing portions 50*a* and 50*b* extend along the long axis L1 of the cartridge body 35 and are arrayed side by side in the direction of the short axis S1 of the cartridge body 35. The filling port 45 of the container 36 is opening at the front end of one toner housing portion 50*a*. The recess 44 of the container 36 is situated at the front end of the other toner housing portion 50*b*. Therefore, the other toner housing portion 50*b* is shorter than the one toner housing portion 50*a* by the size of the recess 44, in the direction of the long axis L1 of the cartridge body 35.

As shown in FIG. 8 and FIG. 9, the bottom wall 39 of the container 36 has a bottom surface 51*a* that is exposed to the toner housing portion 50*a*, and a bottom surface 51*b* that is exposed to the toner housing portion 50*b*. The bottom surfaces 51*a* and 51*b* are examples of inner surfaces of the toner receptacle 43 and are arcuately curved to expand downward of the container 36.

The bottom wall 39 of the container 36 also has a recess 52. The recess 52 is situated between the bottom surface 51*a* and the bottom surface 51*b* and extends straight along the direction of the long axis L1 of the cartridge body 35. The recess 52 is opening to the toner receptacle 43. The recess 52 has a discharge port 53 as shown in FIG. 9. The discharge port 53 is for discharging the toner that is filling the toner receptacle 43, to outside of the cartridge body 35. The discharge port 53 is provided at a position next to the front wall 41 of the container 36 and is opened and closed by a shutter 54.

A first protrusion 55*a* is formed at a boundary part between the bottom surface 51*a* and the recess 52. The first protrusion 55*a* protrudes upward from the bottom wall 39. Similarly, a second protrusion 55*b* is formed at a boundary part between the bottom surface 51*b* and the recess 52. The second protrusion 55*b* protrudes upward from the bottom wall 39. The first and second protrusions 55*a* and 55*b* extend straight along the direction of the long axis L1 of the cartridge body 35 and serve as a partition between the bottom of the toner housing portion 50*a* and the bottom of the toner housing portion 50*b*.

As best shown FIG. 3 to FIG. 5, the first toner cartridge 28 further includes a screw 56 that moves the toner that is filling the toner receptacle 43 to the discharge port 53, and a stirring mechanism 57 to stir the toner that is filling the toner receptacle 43.

The screw 56 has a rotary shaft 58 and a spiral guide blade 59 that is formed on the outer circumferential surface of the rotary shaft 58. The screw 56 is housed in the recess 52 and is exposed to the bottom of the toner receptacle 43. The screw 56 is crossing over the discharge port 53. The rotary shaft 58 of the screw 56 is laid between the rear wall 40 and the front wall 41 of the container 36 and thereby rotatably supported to the container 36.

At the rear end of the rotary shaft 58, a driving gear 61 is coaxially fixed via a seal ring 60. The driving gear 61 is situated on the outside of the rear wall 40 of the container 36. The driving gear 61 has a pair of engagement protrusions 61*a* and 61*b*. When the first toner cartridge 28 is inserted into the cartridge housing portion 27, the engagement protrusions 61*a* and 61*b* mesh with the coupling in the cartridge housing portion 27. This meshing causes the screw 56 to rotate in response to the torque of the driving device.

The stirring mechanism 57 has a pair of stirring members 63 and 64, scrapers 65 and 66 attached to the stirring members 63 and 64, and a pair of gears 67 and 68. One stirring member 63 is provided in the one toner housing portion 50*a* of the toner receptacle 43. The stirring member 63 includes a rotary shaft 70 and a paddle unit 71. The rotary shaft 70 is laid between the rear wall 40 and the front wall 41 of the container 36. The paddle unit 71 is formed by assembling plural bar members into a truss-shape and has two outer frames 72*a* and 72*b* extending in the axial direction of the rotary shaft 70. The outer frames 72*a* and 72*b* are arranged parallel to the rotary shaft 70 and face each other with the rotary shaft 70 in-between. Therefore, the paddle unit 71 has a shape that crosses the rotary shaft 70 in the direction of its diameter.

The stirring member 63 is supported to the container 36 via the rotary shaft 70 and rotates about the rotary shaft 70. When the stirring member 63 rotates, the outer frames 72*a* and 72*b* of the paddle unit 71 move, having a small gap to the bottom surface 51*a* of the toner housing portion 50*a*. The paddle unit 71 also has a spiral carrying blade 73. The carrying blade 73 is situated right beside the discharge port 53 and delivers toner toward the discharge port 53.

The other stirring member 64 includes a rotary shaft 75 and a paddle unit 76. The rotary shaft 75 is laid between the real wall 40 and the recess 44 of the front wall 41 of the container 36. The paddle unit 76 is formed by assembling plural bar members into a truss-shape and has two outer frames 77*a* and 77*b* extending in the axial direction of the rotary shaft 75. The outer frames 77*a* and 77*b* are arranged parallel to the rotary shaft 75 and face each other with the rotary shaft 75 in-between. Therefore, the paddle unit 76 has a shape that crosses the rotary shaft 75 in the direction of its diameter.

The stirring member 64 is supported to the container 36 via the rotary shaft 75 and rotated about the rotary shaft 75. When the stirring member 64 rotates, the outer frames 77*a* and 77*b* of the paddle unit 76 move, having a small gap to the bottom surface 51*b* of the toner housing portion 50*b*.

As shown in FIG. 5, the one stirring member 63 and the other stirring member 64 are arranged parallel to each other with spacing in the direction of the short axis S1 of the cartridge body 35. The distance D between the rotary shaft 70 of the stirring member 63 and the rotary shaft 75 of the stirring member 64 is set at such a value that the rotating paddle units 71 and 76 do not interfere with each other.

The scrapers 65 and 66 are formed by flexible sheet members, for example, made of synthetic resin. The scraper 65 is pasted to the outer frame 72*a* of the stirring member 63, using a double-sided adhesive tape, not shown. The scraper 65 extends over the entire length of the paddle unit 71. The scraper 65 protrudes from the outer frame 72*a* toward the outside of the paddle unit 71. The scraper 65 moves in contact with the bottom surface 51*a* of the toner housing portion 50*a* when the stirring member 63 rotates.

The scraper 66 is pasted to the outer frame 77*a* of the stirring member 64, using a double-sided adhesive tape, not shown. The scraper 66 extends over the entire length of the paddle unit 76. The scraper 66 protrudes from the outer frame 77*a* toward the outside of the paddle unit 76. The scraper 66 moves in contact with the bottom surface 51*b* of the toner housing portion 50*b* when the stirring member 64 rotates.

According to this embodiment, the scrapers 65 and 66 have a positional relation such that the scrapers 65 and 66 contact each other when one of the stirring members 63 and 64 is fixed while the other is rotated.

The gears 67 and 68 are, for example, disc-shaped common components and arranged on the outer side of the rear wall 40 of the container 36. One gear 67 is coaxially fixed at the rear end of the rotary shaft 70 of the stirring member 63. The other gear 68 is coaxially fixed at the rear end of the rotary shaft 75 of the stirring member 64. Since the structures to fix the gears 67 and 68 to the rotary shafts 70 and 75 are common to each other, the fixing structure of the gear 67 to the rotary shaft 70 will now be described as an exemplary.

Figure 6:
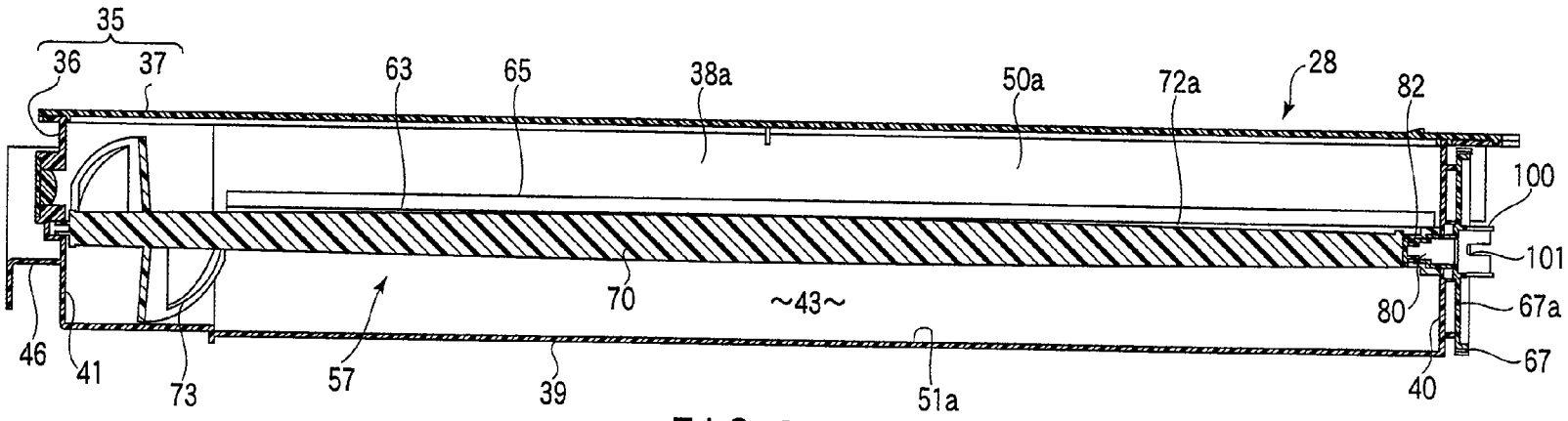
FIG. 6 is an exemplary sectional view taken along a line F6-F6 of FIG. 5.
Figure 7:
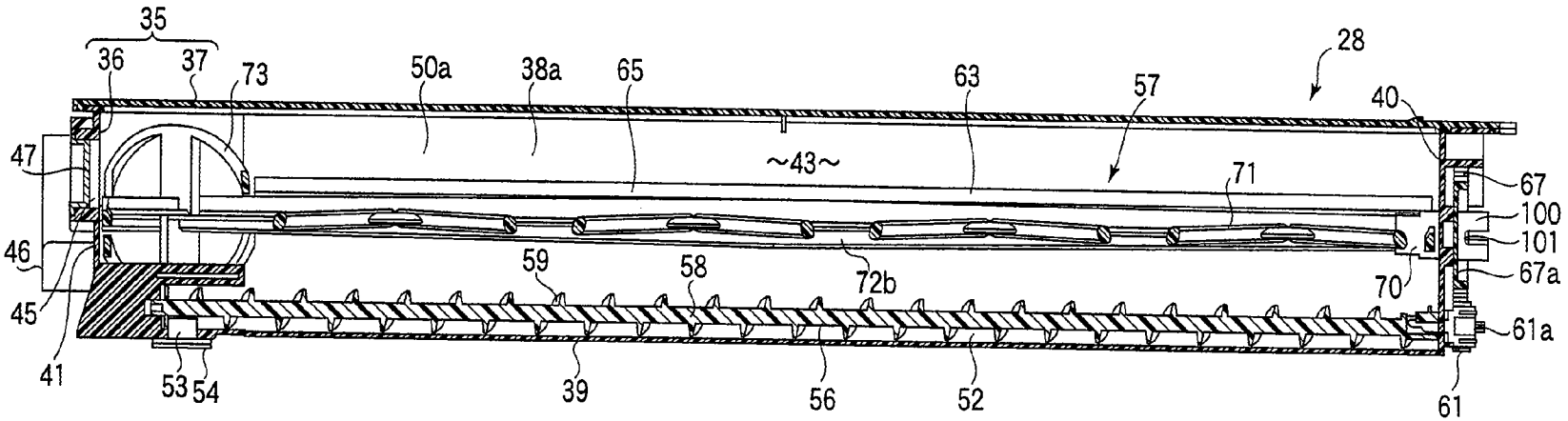
FIG. 7 is an exemplary sectional view taken along a line F7-F7 of FIG. 5.

As shown in FIG. 6, the gear 67 has a cylindrical fitting part 80 at its center of rotation. The fitting part 80 penetrates a bearing hole 81 opened in the rear wall 40 and is fitted in a fitting hole 82 formed at the rear end of the rotary shaft 70. Thus, the gear 67 is integrally connected with the rotary shaft 70 and rotates together with this rotary shaft 70. The fitting part 80 penetrates a washer 83 and a seal ring 84. The seal ring 84 is provided between the rear wall 40 and the gear 67 to prevent leakage of toner from the bearing hole 81.

Figure 10:
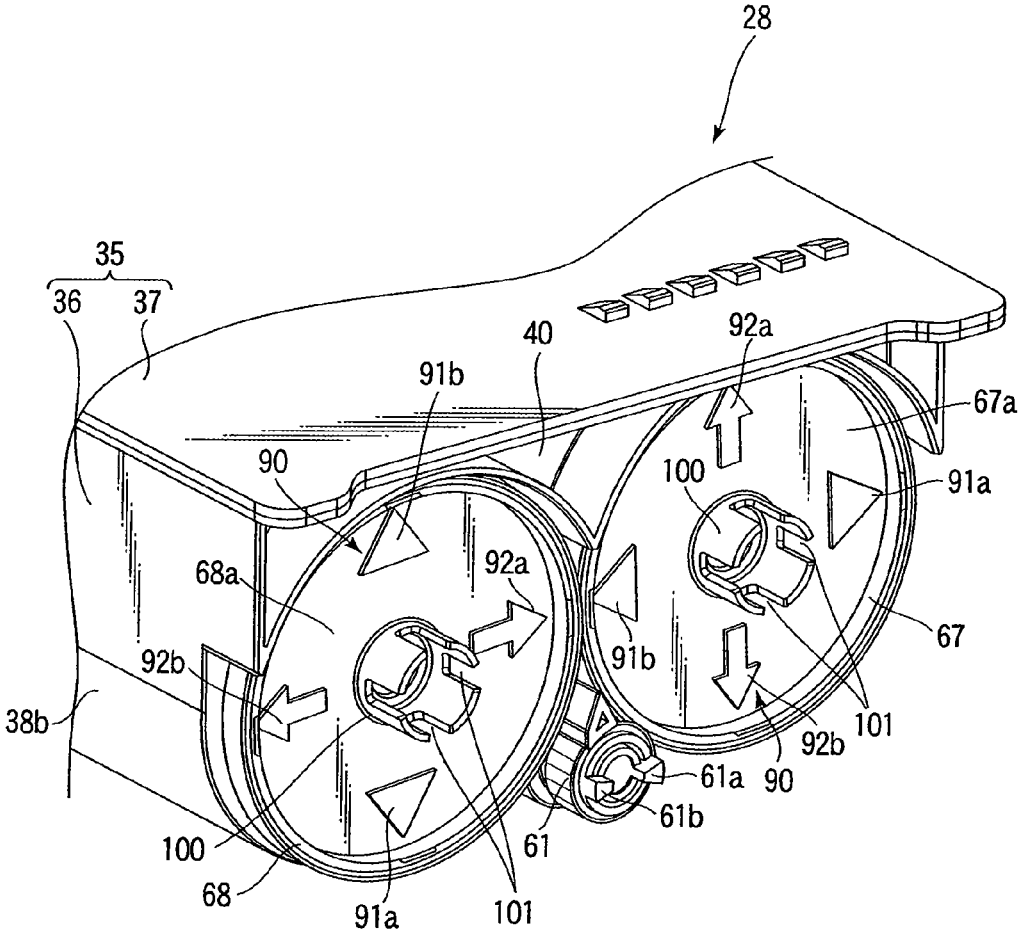
FIG. 10 is an exemplary perspective view of the toner cartridge in the state where a pair of gears mesh with each other in the first embodiment of the invention.

As shown in FIG. 10, the gears 67 and 68 mesh with each other on the outside of the container 36. This meshing causes the stirring members 63 and 64 to rotate synchronously with each other in the opposite directions. In this embodiment, the stirring member 63 rotates counterclockwise as indicated by an arrow A in FIG. 8 and the stirring member 64 rotates clockwise as indicated by an arrow B in FIG. 8.

The gear 67, which rotates together with the stirring member 63, meshes with the driving gear 61. Therefore, when the torque of the driving device is transmitted to the driving gear 61 from the coupling, the screw 56 and the stirring members 63 and 64 rotate synchronously with each other.

As shown FIG. 10, the gears 67 and 68 have circular end surfaces 67*a* and 68*a* exposed to the outside of the cartridge body 35. On each of the end surfaces 67*a* and 68*a* of the gears 67 and 68, a phase display section 90 is formed which shows the meshing position of the gears 67 and 68. The phase display section 90 of this embodiment has a pair of first marks 91*a* and 91*b* having a triangular shape, and a pair of second marks 92*a* and 92*b* having an arrow-shape. The first marks 91*a* and 91*b* and the second marks 92*a* and 92*b* are integrally formed on the end surfaces 67*a* and 68*a* of the gears 67 and 68 in a manner of slightly protruding from the end surfaces 67*a* and 68*a*.

The first marks 91*a* and 91*b* and the second marks 92*a* and 92*b* are alternately arrayed, with their phase along the rotating direction of the gears 67 and 68 shifted by 90 degrees each. Therefore, the arraying direction of the first marks 91*a* and 91*b* and the arraying direction of the second marks 92*a* and 92*b* are orthogonal to each other about the center of rotation of the gears 67 and 68.

According to the first embodiment, the gear 67 is fixed to the rotary shaft 70 of the stirring member 63 so that the triangular first mark 91*a* corresponds to the position of the scraper 65 of the stirring member 63. Similarly, the gear 68 is fixed to the rotary shaft 75 of the stirring member 64 so that the triangular first mark 91*a* corresponds to the position of the scraper 66 of the stirring member 64.

Therefore, in the first embodiment, the gears 67 and 68 are meshed with each other at the position where the other first mark 91*b* of the gear 67 and the arrow-shaped second mark 92*a* of the gear 68 meet each other. Thus, the paddle units 71 and 76 of the stirring members 63 and 64, which rotate synchronously with each other in the opposite directions, are held in the toner receptacle 43 with an attitude shifted by 90 degrees in the rotating directions of the stirring members 63 and 64. Thus, immediately after the first toner cartridge 28 is assembled, the scrapers 65 and 66 fixed to the outer frames 72*a* and 77*a* of the paddle units 71 and 76 are housed in the toner receptacle 43, having a 90-degree phase difference in the rotating directions of the stirring members 63 and 64.

As the torque of the driving device of the image forming apparatus 1 is transmitted to the driving gear 61 from the coupling, the screw 56 rotates via the driving gear 61. Moreover, the driving gear 61 meshes with the gear 67 of the stirring mechanism 57. Therefore, the torque of the driving device is transmitted to the stirring members 63 and 64 through the gears 67 and 68 from the driving gear 61, thereby rotating the stirring members 63 and 64. The stirring members 63 and 64 stir toner in the toner housing portions 50*a* and 50*b* and send out the toner toward the screw 56.

The scrapers 65 and 66 fixed to the stirring members 63 and 64 move in contact with the bottom surfaces 51*a* and 51*b* of the toner housing portions 50*a* and 50*b*. Therefore, the toner located in the gap between the stirring members 63 and 64 and the bottom surfaces 51*a* and 51*b* and the toner adhering to the bottom surfaces 51*a* and 51*b* can be scraped off by the scrapers 65 and 66 into the direction of the screw 56. Thus, the toner that is filling the toner housing portions 50*a* and 50*b* can be effectively supplied to the screw 56 without being wasted.

The screw 56 moves the toner sent from the stirring members 63 and 64, toward the discharge port 53. The toner moved to the discharge port 53 is supplied from the discharge port 53 to the developing device 22 of the first image forming unit 16.

As shown in FIG. 10, a cylindrical section 100 is integrally formed on each of the end surfaces 67*a* and 68*a* of the gears 67 and 68. The cylindrical sections 100 are coaxially protrude in the direction opposite to the cartridge body 35 from the end surfaces 67*a* and 68*a* of the gears 67 and 68. The cylindrical sections 100 are for optically detecting the type of the first toner cartridge 28, for example, by a technique similar to the technique employed in the toner cartridge disclosed in Japanese Patent Publication (KOKAI) No. 2007-310146.

Specifically, each cylindrical section 100 has four slits 101. The slits 101 extend in the axial direction of the cylindrical section 100 and are arrayed at equal spacing in the circumferential direction of the cylindrical section 100. When the first toner cartridge 28 is inserted into the cartridge housing portion 27 of the image forming apparatus 1, the cylindrical sections 100 coincide with photo detectors (not shown) provided at the terminal end of the cartridge housing portion 27.

As disclosed in the above Patent Publication, the photo detector includes a light emitting element and a light receiving element. The light emitting element and the light receiving element face each other with spacing. The light emitting element is situated at a rotation center part of the cylindrical section 100. The light receiving element is situated on the outside of the cylindrical section 100.

When the cylindrical sections 100 rotates together with the gears 67 and 68, the slits 101 pass between the light emitting element and the light receiving element, one after another. The light receiving element receives light from the light emitting element when the slits 101 exist between the light receiving element and the light emitting element. When the light receiving element receives light from the light emitting element, the photodetector outputs a first signal to a control unit. When light directed toward the light receiving element from the light emitting element is interrupted by the cylindrical section 100, the photodetector outputs a second signal to the control unit.

The control unit detects a time L when the photodetector outputs the first signal and a time H when the photodetector outputs the second signal. When the value of (time L)/(time H) is within a predetermined range, the control unit determines that the first toner cartridge 28 is a genuine product recommended by the manufacturer. When the value of (time L)/(time H) is out of the predetermined range, the control unit determines that the first toner cartridge 28 is not a genuine product. The result of the determination by the control unit is displayed on the control panel of the image forming apparatus 1.

According to the first embodiment, the gears 67 and 68 are meshed with each other at the position where the first mark 91*b* on the gear 67 and the second mark 92*a* on the gear 68 meet each other. Therefore, a phase difference of 90 degrees along the rotating directions of the stirring members 63 and 64 can be secured between the scrapers 65 and 66 of the stirring members 63 and 64, which rotate synchronously with each other in the opposite directions.

Thus, mutual interference between the scrapers 65 and 66 of the stirring members 63 and 64 can be avoided and damage to the scrapers 65 and 66 can be prevented.

Moreover, when assembling the first toner cartridge 28, the operator can simply watch the first and second marks 91*a*, 91*b*, 92*a* and 92*b* to recognize the optimum meshing position of the gears 67 and 68 where interference between the scrapers 65 and 66 can be avoided. Thus, operability in assembling the first toner cartridge 28 can be improved.

The invention is not limited to the above first embodiment. Various changes and modifications can be made without departing from the scope of the invention.

Figure 11:
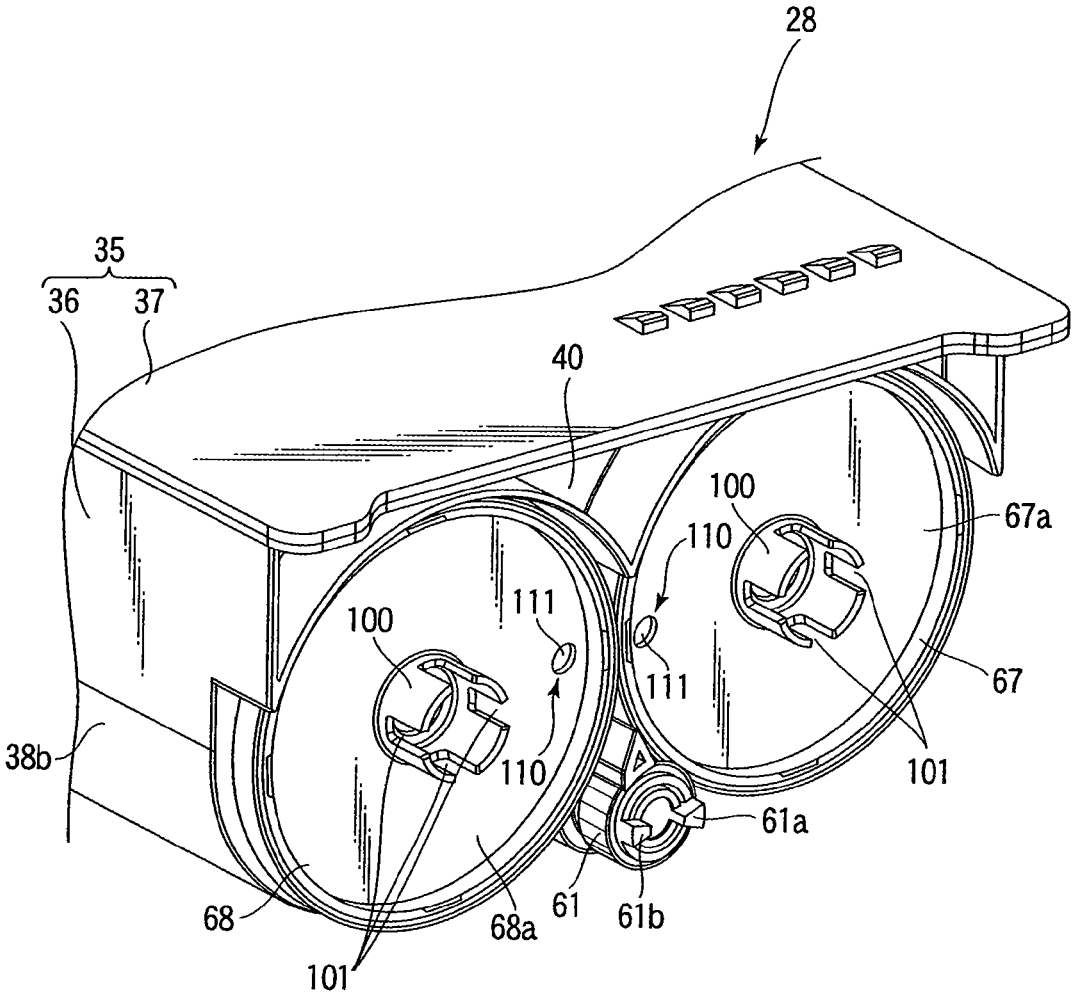
FIG. 11 is an exemplary perspective view of a toner cartridge according to a second embodiment of the invention.

FIG. 11 shows a second embodiment of the invention.

The second embodiment differs from the first embodiment in the configuration of a phase display section 110 formed on each of the end surfaces 67*a* and 68*a* of the gears 67 and 68. The other parts of the configuration of the first toner cartridge 28 are similar to the first embodiment.

As shown in FIG. 11, each of the phase display sections 110 has one recess 111 slightly recessed from the end surfaces 67*a* and 68*a* of the gears 67 and 68. Each recess 111 is formed at a position shifted by 90 degrees from the scraper in the rotating direction of the stirring member.

With such a configuration, as the gears 67 and 68 are meshed with each other at the position where the recesses 111 of the gears 67 and 68 meet each other, interference between the scrapers of the stirring members, which rotate synchronously with each other in the opposite directions, can be avoided.

In the invention, the phase display sections of the gears are not limited to protrusions protruding from the end surfaces of the gears or recesses on the end surfaces. For example, at least in a part of the end surfaces of the gears, an area colored in a different color from the end surfaces may be provided and this area may be used as a mark. That is, any form of mark that can show the meshing position of the gears can be employed.

Additionally, the shape of the gears is not limited to a disc-shape. For example, a gear may be employed which includes a rim having plural cogs, a boss rotating integrally with the rotary shaft, and plural arms connecting the boss and the rim. In the gear of this type, it is desirable to form a mark on the rim or arm.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A toner cartridge comprising:

a toner receptacle that houses toner; and a stirring mechanism that stirs the toner in the toner receptacle, the stirring mechanism including (1) a pair of stirring members that rotate in the toner receptacle, (2) a scraper attached to each of the stirring members that scrapes off toner adhering to an inner surface of the toner receptacle, (3) a pair of gears rotating together with the stirring members, the gears meshing with each other outside of the toner receptacle and thereby rotating the stirring members synchronously with each other, each of the gears including an end surface exposed to the outside of the toner receptacle, (4) a phase display section that shows a meshing position of the gears so that the gears mesh with each other at a position where a phase difference along a rotating direction of the stirring members occurs between the scrapers of the stirring members that are next to each other, the phase display section including a first mark and a second mark displayed on the end surface of each of the gears, the first mark being provided at a position corresponding to the scraper, and the second mark being provided at a position which is shifted in a rotating direction of the stirring member with respect to the scraper.

2. The cartridge according to claim 1, wherein the toner receptacle includes (1) a pair of toner housing portions, each being provided with the pair of stirring members, and having a bottom surface that is arcuately curved to allow contact with the scraper of the stirring member, and (2) a discharge port through which the toner is discharged out of the toner housing portions, and the stirring mechanism has a screw that rotates to carry the toner toward the discharge port, the screw having a driving gear that meshes with the gear of one of the stirring members on the outside of the toner receptacle.

3. The cartridge according to claim 2, wherein the screw is provided between the stirring members.

4. The cartridge according to claim 1, wherein the phase display section includes a third mark displayed on the end surface of each of the gears, the third mark being provided at a position where a phase along the rotating direction of the stirring member is shifted by 180 degrees with respect to the first mark, and a phase difference along the rotating direction of the stirring members occurs between the scrapers of the stirring members that are next to each other as the gears mesh at a position where the second mark of one gear and the third mark of the other gear meet each other.

5. The cartridge according to claim 4, wherein the second mark is provided at a position where a phase along the rotating direction of the stirring member is shifted by 90 degrees with respect to the first mark.

6. The cartridge according to claim 1, wherein the phase display section includes a third mark and a fourth mark displayed on the end surface of each of the gears, the third mark being provided at a position where a phase along the rotating direction of the stirring member is shifted by 180 degrees with respect to the first mark, the fourth mark being provided at a position where a phase along the rotating direction of the stirring member is shifted by 180 degrees with respect to the second mark, and a phase difference along the rotating direction of the stirring members occurs between the scrapers of the stirring members that are next to each other as the gears mesh at a position where the first mark of one gear and the fourth mark of the other gear meet each other.

7. The cartridge according to claim 6, wherein the second mark is provided at a position where a phase along the rotating direction of the stirring member is shifted by 90 degrees with respect to the first mark.

8. An image forming apparatus comprising:

an image forming unit having a developing device; and a toner cartridge that supplies toner to the developing device of the image forming unit;

wherein the toner cartridge includes:

a toner receptacle that houses toner;

a pair of stirring members housed in the toner receptacle, the stirring members being next to each other in the toner receptacle and rotating to stir the toner, each of the stirring members having a scraper that scrapes off the toner adhering to an inner surface of the toner receptacle;

a pair of gears rotating together with the stirring members, the gears meshing with each other outside of the toner cartridge and thereby rotating the stirring members synchronously with each other, each of the gears including an end surface exposed to the outside of the toner cartridge; and a phase display section that shows a meshing position of the gears so that the gears mesh with each other at a position where a phase difference along a rotating direction of the stirring members occurs between the scrapers of the stirring members that are next to each other, the phase display section including a first mark and a second mark displayed on the end surface of each of the gears, the first mark being provided at a position corresponding to the scraper, and the second mark being provided at a position which is shifted in a rotating direction of the stirring member with respect to the scraper.

9. The apparatus according to claim 8, wherein each of the gears has a cylindrical section protruding from its end surface, and the cylindrical section rotates together with the gear and has plural slits used for optically determining a type of the toner cartridge.

10. The apparatus according to claim 8, wherein the toner receptacle further includes (1) a pair of toner housing portions, each being provided with the stirring members, and having a bottom surface that is arcuately curved to allow contact with the scraper of the stirring member, (2) a discharge port through which the toner is discharged out of the toner housing portions, and (3) a screw that carries the toner toward the discharge port, the screw being provided between the stirring members and having a driving gear that meshes with the gear of one of the stirring members on outside of the toner receptacle.

11. The apparatus according to claim 8, wherein the phase display section includes a third mark displayed on the end surface of each of the gears, the third mark being provided at a position where a phase along the rotating direction of the stirring member is shifted by 180 degrees with respect to the first mark, and a phase difference along the rotating direction of the stirring members occurs between the scrapers of the stirring members that are next to each other as the gears mesh at a position where the second mark of one gear and the third mark of the other gear meet each other.

12. The apparatus according to claim 8, wherein the phase display section includes a third mark and a fourth mark displayed on the end surface of each of the gears, the third mark being provided at a position where a phase along the rotating direction of the stirring member is shifted by 180 degrees with respect to the first mark, the fourth mark being provided at a position where a phase along the rotating direction of the stirring member is shifted by 180 degrees with respect to the second mark, and a phase difference along the rotating direction of the stirring members occurs between the scrapers of the stirring members that are next to each other as the gears mesh at a position where the first mark of one gear and the fourth mark of the other gear meet each other.

* * * * *